US006810706B2

(12) United States Patent
Clark et al.

(10) Patent No.: US 6,810,706 B2
(45) Date of Patent: Nov. 2, 2004

(54) APPARATUS FOR REDUCING TENSION VARIATIONS IN A METAL STRIP

(75) Inventors: Michael Clark, Sheffield (GB); Anthony Marples, Rotherham (GB)

(73) Assignee: VAI Industries (UK) Limited, Dorset (GB)

( * ) Notice: Subject to any disclaimer, the term of this patent is extended or adjusted under 35 U.S.C. 154(b) by 0 days.

(21) Appl. No.: 10/619,166

(22) Filed: Jul. 10, 2003

(65) Prior Publication Data

US 2004/0007035 A1 Jan. 15, 2004

Related U.S. Application Data

(63) Continuation of application No. 09/930,896, filed on Aug. 15, 2001, now abandoned.

(30) Foreign Application Priority Data

Aug. 17, 2000 (GB) ..... 0020160

(51) Int. Cl.[7] ..... B21C 47/00

(52) U.S. Cl. ..... 72/148; 72/10.1; 72/10.3; 72/14.7; 72/205; 242/534

(58) Field of Search ..... 72/10.1, 10.3, 72/12.1, 13.4, 14.7, 146, 148, 205, 229, 250, 365.2; 242/412.2, 412.3, 413.2, 419.2, 534

(56) References Cited

U.S. PATENT DOCUMENTS

| | | | | |
|---|---|---|---|---|
| 4,391,417 A | | 7/1983 | Gronbech | |
| 4,463,586 A | | 8/1984 | Griffin | |
| 4,736,605 A | | 4/1988 | Klockner et al. | |
| 4,905,491 A | | 3/1990 | Starke et al. | |
| 4,934,224 A | | 6/1990 | Brown | |
| 4,964,587 A | | 10/1990 | Oki et al. | |
| 5,176,334 A | | 1/1993 | Dreschau et al. | |
| 5,778,717 A | * | 7/1998 | Berger et al. | 72/205 |
| 6,039,283 A | * | 3/2000 | Munoz-Baca et al. | 242/534 |
| 6,334,238 B2 | * | 1/2002 | Hartung | 19/236 |

FOREIGN PATENT DOCUMENTS

| | | |
|---|---|---|
| DE | 1981207 | 10/1999 |
| DE | 19818207 | 10/1999 |
| GB | 2074138 A | 10/1981 |
| JP | 58-1341.1 | 1/1983 |
| WO | WO 99/55474 | 4/1999 |

OTHER PUBLICATIONS

Acesita Steckel Modifications Hot Strip Rolling Mill Project Evaluation Design Philosophy, Part 3, Section 3.2 of May 9, 1995 Proposal, pp. 1–14.

Acesita Steckel Modifications Hot Strip Rolling Mill Automation Functional Description, Part 7, Section 3 of May 9, 1995 Proposal, pp. 1–60.

* cited by examiner

*Primary Examiner*—Ed Tolan
(74) *Attorney, Agent, or Firm*—Daniel B. Schein, Esq.

(57) ABSTRACT

The invention provides apparatus and methods for coiling and uncoiling a metal strip in which the angular position of a coiler is measured and an actuator is provided for a moveable roll, the moveable roll position being varied as a function of the coiler. The present invention aims to avoid tension variations in the metal which cause width and thickness variations in rolling operations for instance.

30 Claims, 7 Drawing Sheets

APPARATUS FOR REDUCING TENSION VARIATIONS IN A METAL STRIP

This application is a continuation of application Ser. No. 09/930,896, filed Aug. 15, 2001, now abandoned, which is hereby incorporated by reference herein.

The present invention relates to apparatus for reducing tension variations in a metal strip being coiled and/or uncoiled. In particular it relates to the coiling and/or uncoiling of metal strips in the furnace coiling/uncoiling drums of a Steckel type rolling mill in which the metal strip passes from the uncoiling drum to the coiling drum via a reduction stand. It is also applicable to other mill types, both reversing and non-reversing, for steel and other metals.

In a conventional Steckel mill a major factor in causing tension variations during coiling and uncoiling is the eccentric build up of the coil on a coiling drum. This is a particular problem in Steckel rolling because the design of the Steckel coiling/uncoiling drums tends to produce a bump in the diameter of the coil at the position of the slot in the coiling drum. It is obvious that as the coiler drum rotates the larger coil diameter, at the position of the bump caused by the drum slot, results in an increase in circumferential speed at this point and hence in an increase in rate at which strip is wound onto the drum. If strip is wound onto the drum faster than it is exiting the mill stand then the differential speed causes the strip to be stretched and this increases the tension. This results in undesirable variations in the product.

U.S. Pat. No. 4,905,491 discloses a method for reducing the cyclic tension changes caused by coil eccentricity. This method relies on a tension measuring device and the analysis of the variations in this tension to generate control signals to either the coiler motor torque or the roll gap. However, it is easy to show by calculations that the inertia of the coiler motor plus the coiler drum in a conventional Steckel mill is so large that it is not possible to accelerate and decelerate the coiler fast enough to compensate for eccentricity of the coil at conventional Steckel rolling speeds. Therefore the practical application of this patent on a Steckel mill would require that the roll gap is used to control the tension. It is well known that changing the roll gap during rolling changes the entry speed of the strip in proportion to the change in the exit thickness but it has only a very small effect on the exit speed of the strip. Consequently this method can only be used on the uncoiler and is not suitable for a coiler on the exit side. Another problem is that modifying the roll gap changes the exit thickness of the strip as well as changing the entry-speed. Consequently the use of the roll gap to control the tension will make the thickness variations worse. This is precisely the opposite of the desired effect which is to improve the thickness and width tolerances of the strip by reducing the tension variations.

GB2074138 discloses another method of reducing the tension variations due to eccentricity of the coil. This method uses a sensor to measure the diameter of the coil as it rotates and it applies the signal from this sensor to the motor speed control. It is simple to show by calculation that the inertia of a conventional Steckel mill coiler motor and drum is so large that it would not be possible to accelerate and decelerate the coiler/uncoiler fast enough to follow the signal from the coil diameter sensor.

It is therefore the objective of this invention to reduce the tension variations caused by eccentricity of the coil in order to improve the width and thickness tolerances of the rolled metal strip in a way which overcomes the problems discussed in the prior art. It is a further objective of this invention to improve the mill stability and to reduce risk of strip breakage and equipment damage by minimising the tension variations due to coil eccentricity. The present invention uses anticipatory adjustment to achieve this. Reactive attempts to address the problem, as provided in the prior art, are unsuitable due to to inertia effects.

According to a first aspect of the invention we provide an apparatus for the handling of a metal strip, wherein the apparatus includes a first coiler and second coiler and a moveable roll, a strip path being defined between a first location and a second location, movement of the movable roll changing the length of the strip path, the apparatus further including a measurer of the angular position of at least one of the coilers and an actuator for the moveable roll, the actuator being provided with signals from the measurer, the position of the moveable roll being defined, at least in part, as a function of the angular position of at least one of the coilers.

Preferably both the first coiler and the second coiler are provided with a measurer of the angular position of the coiler. Preferably one or both of the coilers are fitted with angular position transducers to measure the angular position of the coiler or coilers during coiling or uncoiling.

The first and/or second coilers are preferably coiler drums. Preferably the first and/or second coilers are provided with a slot for receiving an end of the metal strip in use. Preferably the slot is defined as a part of a chord to the circular cross section of the coiler. Preferably the angular position of a slot in the first and/or second coilers is measured.

In addition the invention may provide that one or more of the rolls are moveable pinch rolls. The rolls may be fitted with position transducers and/or roll position controllers, such as hydraulic actuators. Preferably a control system which controls the position of the rolls in response to the signals is also provided. The control system may control the position of the rolls in response to information from the measurer or measurers alone. It is preferred, however, that the control system controls the position of the rolls in response to that information in combination with further information. A database may be provided to store the further information. Preferably the information and further information are combined to give an overall control signal to the roll position controllers.

Preferably a moveable roll is provided between a coiler and a rolling mill stand or other processing stage. Preferably a roll is provided between each coiler and a rolling mill stand or other process stage. Preferably the movement of the roll changes the length of the strip path between a coiler and the rolling mill stand or other processing stage. The first location may be a rolling stand or other process stage. The second location may be the coiler, or more particularly the part of the coiler at which the metal strip comes into contact with the coiler, or alternatively the location at which the metal strip comes into contact with a part of the metal strip coiled on the coiler. It is preferred that the second location is a further roll, particularly a deflector roll. Preferably the first and second locations are at fixed positions and/or in a fixed configuration relative to one another. Preferably at least one further roll is provided between a coiler and a roll. Preferably a further roll is provided between each coiler and its respective rolls. Preferably the further roll is a deflector roll. The movement of the roll may change the length of the strip path between the further roll and the rolling mill stand or other process stage. The apparatus may include a rotational speed measurer for one or more of the coilers. Preferably signals from the rotational speed measurer are provided to the control system. The rotational speed measurer may be the same as the angular position measurer. The apparatus may be provided with a tension measurer for the strip. The apparatus may be provided with a load measurer for the moveable roll. Preferably signals from the tension measurer and/or load measurer are provided to the control system. The apparatus may include a strip coil diameter measurer, preferably one for each coiler. Preferably signals from the strip coil diameter measurer are provided to the control system.

Preferably two moveable rolls and their associated controllers are provided on a reversing mill, one reducing the tension variations of the uncoiling product and one reducing the tension variations of the coiling product.

According to a second aspect of the invention we provide a method of handling a metal strip, the method comprising providing a first coiler and a second coiler, and a metal strip, passing the metal strip from a first coiler to a second coil r, a strip path for the metal strip being defined between a first location and a second location, a moveable roll contacting the metal strip between the first location and second location, the method including measuring the angular position of at least one of the coilers and moving the moveable roll so as to change the length of the strip path, the moveable roll being moved as a function of the angular position of at least one of the coilers.

Preferably the method measures the angular position using one or more angular position transducers.

Preferably the metal strip is coiled and/or uncoiled on coiler drums.

Preferably the method measures the angular position of the location at which the lead end of the metal strip engages the coiler.

Preferably the method measures the position of the moveable roll or rolls using position transducers. Preferably the moveable rolls are moved using roll position controllers, particularly hydraulic actuators. Preferably the roll position controllers are controlled by a control system. The control system preferably receives information from the measurer or measurers. Preferably the control system receives further information. It is preferred that the control system controls the position of the rolls in response to the information in combination with the further information. Preferably the information and further information are combined to provide an overall control signal to the roll position controller or controllers. The further information may be information about one or more of the thickness of the strip, the material forming the strip, the temperature of the strip, the number of passes of the strip through the rolling mill stand or other process stage, the number of laps of the strip on the coiler, the geometry of the strip length, the geometry of the moveable roll to the rolling mill stand or other process stage, the geometry of the moveable roll to the further roll, the response time of the moveable roll and the speed of rotation of the coiler.

Preferably the movement of the roll changes the length of the strip path between a coiler and the rolling mill stand or other process stage. It is particularly preferred that the movement of the roll changes the length of the strip path between a rolling mill stand or other process stage and a further roll.

The movement of the roll is preferably effected to adjust for the profile of the eccentricity in the coil. The profile may include an account of the predicted amplitude of the eccentricity in the coil and/or of the predicted duration of eccentricity in the coil. The invention may also provide a method which calculates the predicted amplitude of the eccentricity in the coil. The predicted amplitude of the eccentricity in the coil may be calculated as a function of the thickness of the strip and/or of the material forming the strip and/or of the temperature of the strip and/or of the number of passes of the strip through the rolling mill stand or other process stage and/or the number of laps of the strip on the coiler.

Preferably the method provides for a pattern of roll movement over time. Preferably the pattern of roll movement is calculated. Preferably the pattern is cyclic. The system may calculate the pattern of roll movement which is required to compensate for the difference in speed between the mill and the circumferential speed of the coiler. The pattern of roll movements is preferably applied by the roll position controllers.

The invention may provide a method of operation which causes the roll to follow a predetermined pattern of movements according to the angular position of the coiler. In this way the tension variations due to the coil eccentricity can be significantly reduced provided that the anticipated amplitude of the coil eccentricity is correct.

The invention may further provide for the storage of tables of values of the predicted eccentricity amplitude according to the grade, thickness and temperature of the material being rolled.

The invention may further provide one or more methods by which the system corrects the calculated eccentricity amplitude to give a corrected eccentricity amplitude. The method may correct the calculated eccentricity amplitude by measuring the rotational speed of the coiler. A decrease in speed of the coiler corresponding to the strip being applied over the location of eccentricity preferably results in a corrected eccentricity amplitude which is greater than the calculated eccentricity amplitude. Preferably an increase in the rotational speed of the coiler at an angular position where the strip is applied over the location of the eccentricity results in a corrected eccentricity amplitude which is lower than the calculated eccentricity amplitude. The calculated eccentricity amplitude may be corrected by measuring the tension in the strip and/or by measuring the load on the moveable roll. Preferably the method provides that if the tension in the strip increases and/or the load on the roll increases as the strip is applied over the position of the eccentricity then the corrected eccentricity amplitude is greater than the calculated eccentricity amplitude. Preferably the method provides that if the tension is reduced and/or the load on the roll is reduced as the strip is applied over the location of the eccentricity then the corrected eccentricity amplitude is less than the calculated eccentricity amplitude. The calculated eccentricity amplitude may be corrected by measuring the coil diameter and particularly the coil diameter for the eccentricity.

The invention may further provide for the signal to the roll position controllers to be phase advanced, preferably in order to compensate for the response time of the roll. The phase advance may also compensate for the speed of rotation of the coiler. Preferably the speed of rotation of the coiler is calculated from measurements made by the measurer. The phase advance may also be compensated to account for the geometry of the system, particularly the strip length between the coiler and moveable roll.

The operation of the pinch roll units in position control overcomes the inertia problems associated with operating these units in force or pressure control or with a spring because the force required to overcome the inertia of the roll and move it to a new position is provided by the hydraulic actuator and not by the strip. The method of moving the pinch roll purely as a function of the angular position of the coiler drum also avoids any problems associated with tension measurement. The method of moving the pinch roll as a function of the angular position of the coiler drum also allows the signal to be phase advanced to compensate for the response time to the pinch roll system.

According to a third aspect of the invention we provide an apparatus for the coiling/uncoiling of metal strip which includes a moveable roll in the strip path such that movement of this roll changes the length of the strip path to the coiler/uncoiler and which further includes a transducer measuring the angular position of the coiler/uncoiler and which further includes the position of the moveable roll being automatically controlled as a function of the coiler/un coiler angular position.

The pattern of movement of the moveable roll as a function of the coiler/uncoiler angle may be chosen to reduce the tension variations caused by eccentricity of the coil diameter. The pattern of movement of the pinch roll as a function of the angular position of the coiler/uncoiled may be calculated in advance of the coiling operation function of the anticipated eccentricity amplitude of the coil and the geometry of the moveable roll. The anticipated amplitude of the eccentricity may be based on the material type and/or the material thickness and/or the material temperature and/or the number of laps on the coil. An offset may be added to the measured coiler/uncoiler angular position in order to phase advance the signal to compensate for the response time of the moveable roll. The offset may be a function of the coiler drum speed. The moveable roll may be moved by a hydraulic cylinder. A position transducer may be used to measure the position of the roll. An electronic controller and a servo valve may be used to control the position of the pinch roll according to a reference position. The measurements of the coiler/uncoiler speed may be used to increase or decrease the predicted coil eccentricity amplitude and thus to modify the amplitude of the movements of the moveable roll. Measurements of strip tension may be used to increase or decrease the predicted coil eccentricity amplitude and thus to modify the amplitude of the movements of the moveable roll.

There now follows a more detailed description of a specific embodiment of the method and apparatus according to the invention with the help of the attached drawings in which.

Steckel mills and other mill types are often employed in processing of metal strips. In general, the metal strip is passed from one coiling drum to another via a processing stage, such as a thickness reduction stage. Reduction stands are often used for this task. The coiling drums often provide re-heating of the metal strip to maintain its workability. During each pass the lead end of the strip has to be introduced to the coiling drum in a manner which facilitates subsequent coiling of the strip on to the coiling drum.

Figure 1:
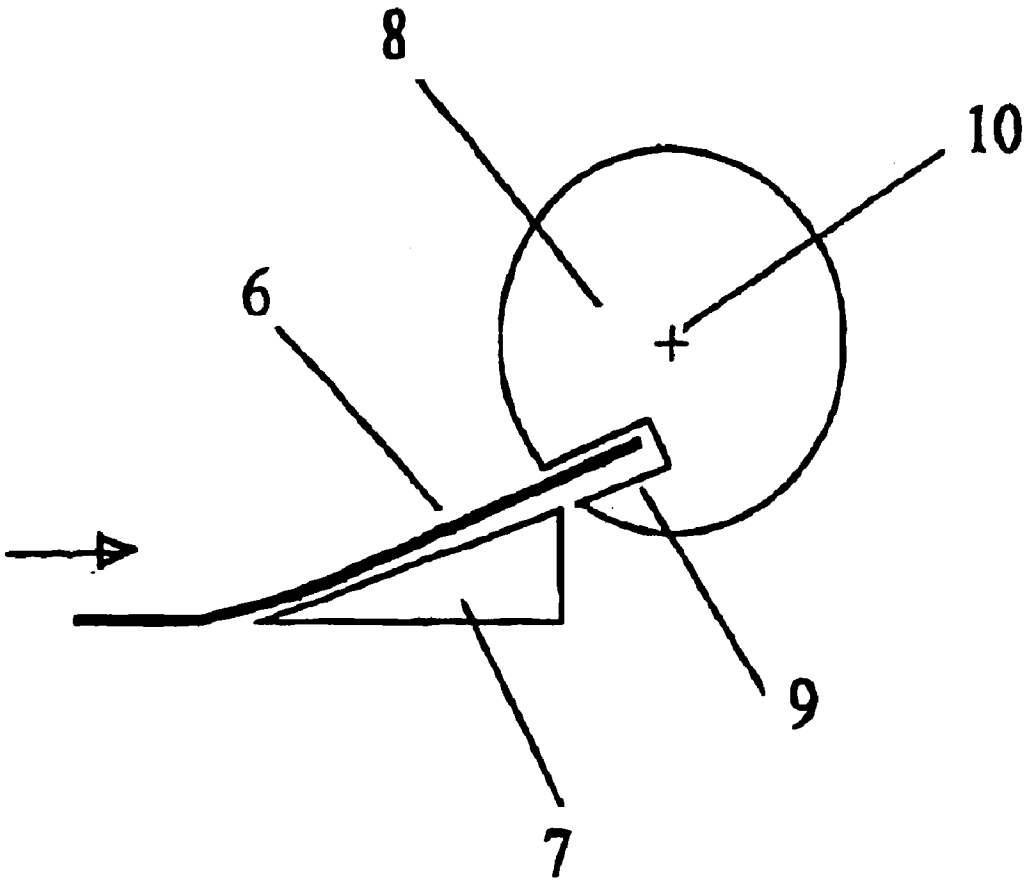
FIG. 1 is a diagram showing a side view of the head of a strip entering the slot in the coiler drum.
Figure 2:
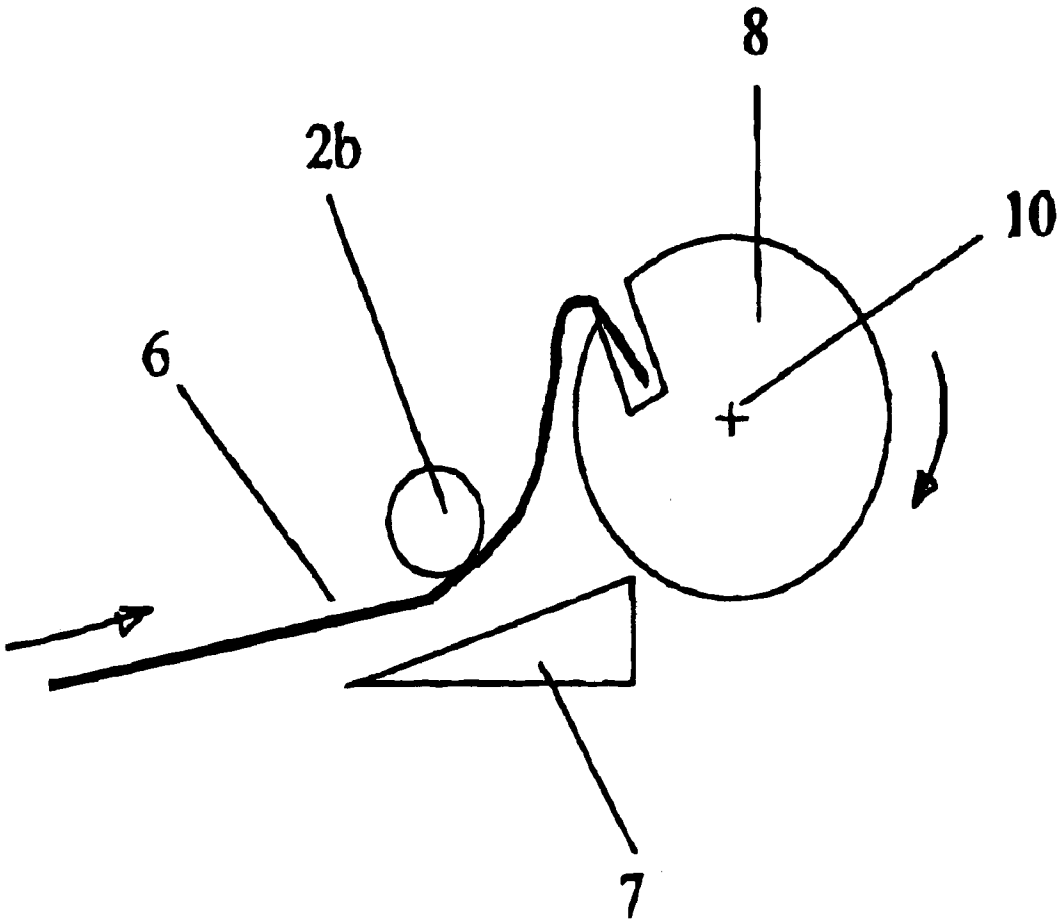
FIG. 2 is a diagram showing a side view of the bending of the head end of a strip around the corner of the coiler drum slot after an initial rotation of the coiler drum following threading.
Figure 3:
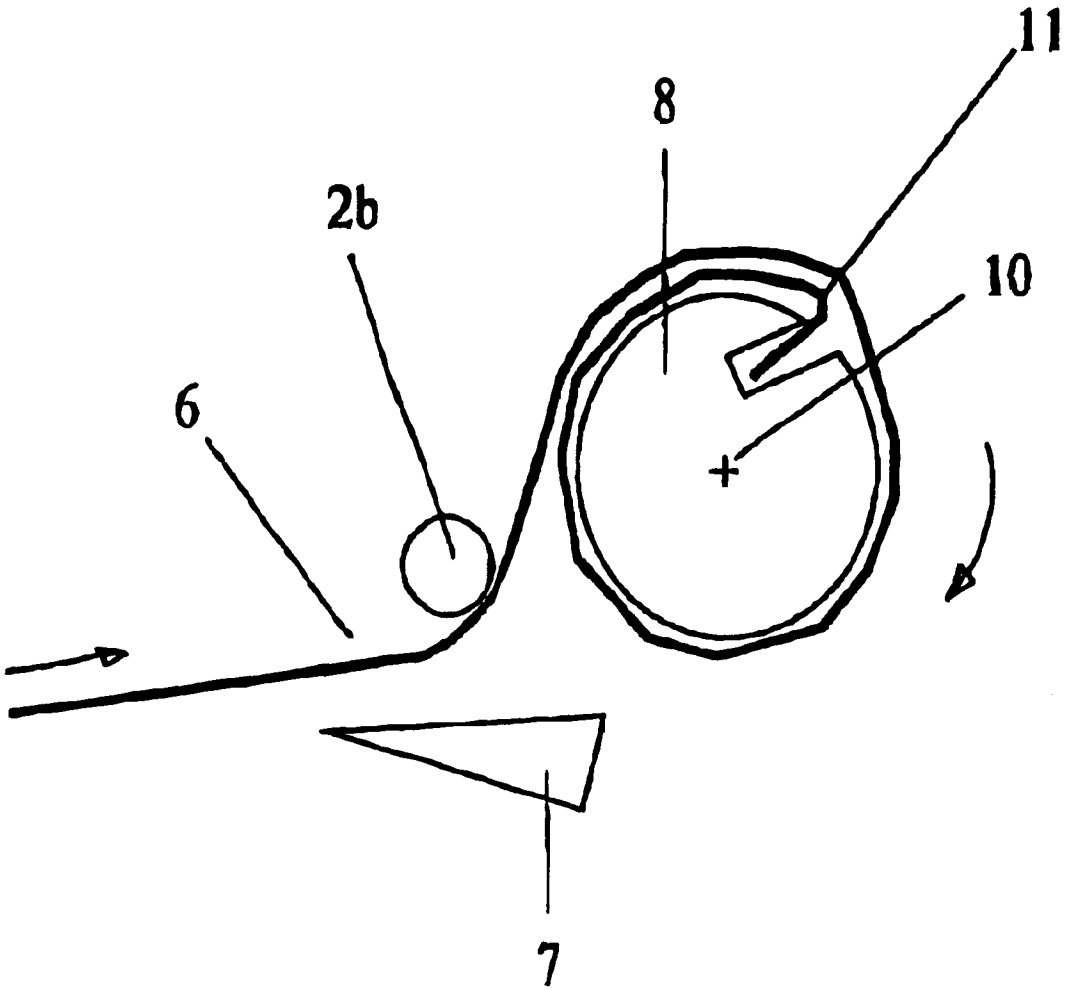
FIG. 3 is a diagram showing a side view of the coiler drum after one complete lap has been threaded showing the eccentricity in the coil diameter caused by the bump where the strip bends around the corner of the slot in the coiler drum.

The process of threading a conventional steckel coiling drum is illustrated in FIGS. 1 through 3. In FIG. 1, the head end of the metal strip 6 is diverted by the deflector gate 7 into the slot in the coiling drum 8. In FIG. 2 the drum 8 starts to rotate about its axis 10 so that the metal strip is bent around the corner of the slot and under the deflector roll 2*b*. Further rotation of the drum is illustrated in FIG. 3 with one complete lap is shown on the drum together with the start of the next lap. The deflector gate 7 is normally moved out of the way once the strip has threaded the drum, The eccentricity in the coil can be clearly seen at the point 11. The bump is caused by the bending of the strip around the corner of the slot. The corner of the slot is normally manufactured with a radius in order to reduce the magnitude of this bump. However the bend radius of the metal strip is effected by many factors including its thickness, material grade and temperature. Consequently the radius on the corner of the slot can only match certain conditions and a bump will still be formed for other thicknesses, grades or temperatures.

The coiler drums are usually driven by electric motors and it is normal practise when coiling to control the torque applied by these electric motors in such a way that in steady state the correct tension is applied to the strip and the torque due to the strip tension balances the torque due to the motor.

At each revolution of the drum the effect of the coil eccentricity is to cause the tension to increase and then decrease. During this disturbance the torque from the motor no longer balances the torque due to strip tension and hence there is a torque trying to change the speed of the coiler drum. In practical coiling machines the inertia of the electric motor plus the coiler drum is large and consequently the tension variation required to decelerate the coiler speed is very large and this large tension variation causes the width and thickness of the strip to change. Since the correct width and thickness are two of the principal requirements in the production of quality metal strip this is very undesirable.

Figure 4:
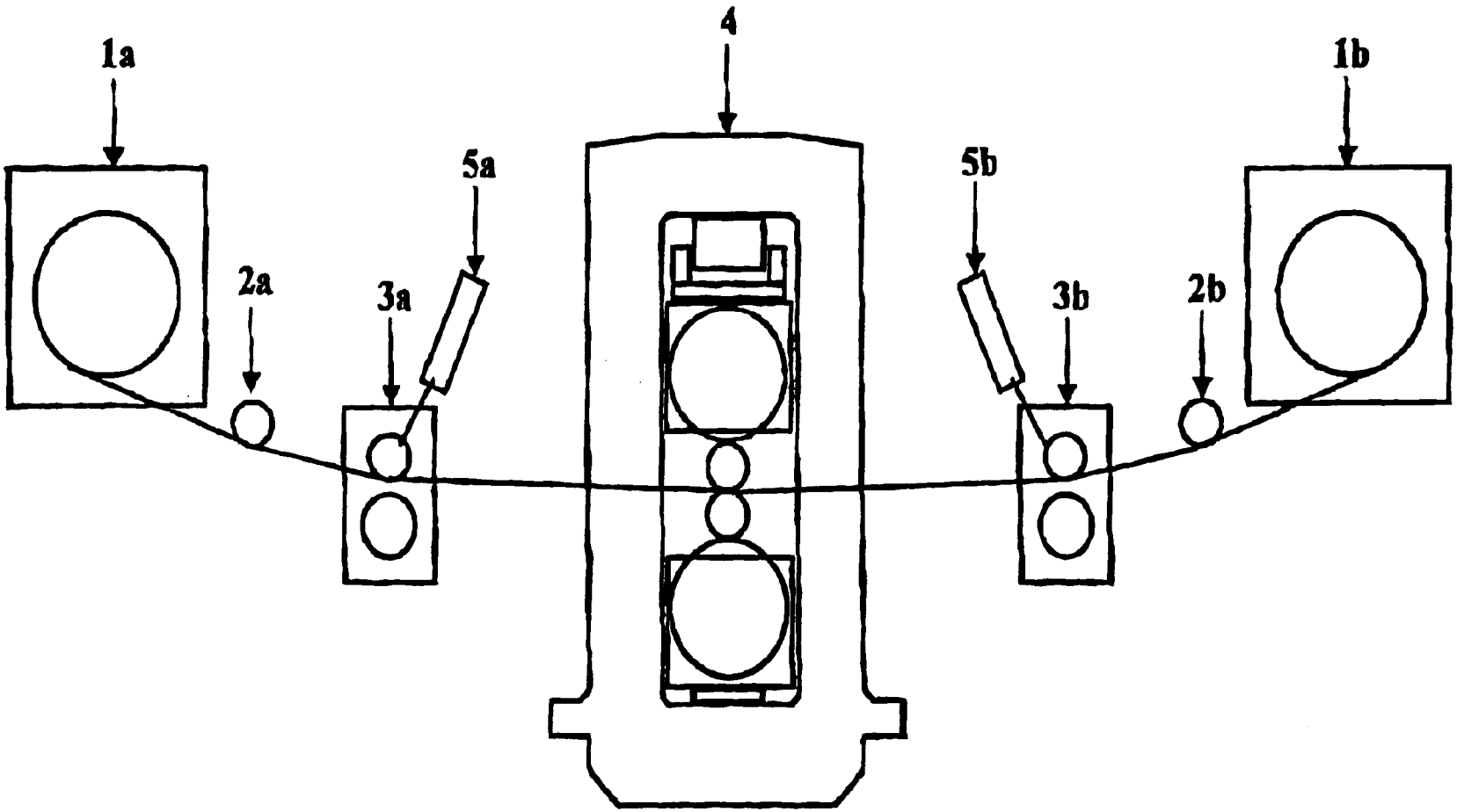
FIG. 4 is a diagram showing the side view of a Steckel rolling mill.

One method of reducing the tension variations caused by coil eccentricity which appears in the prior art is the use of pinch rolls such as the rolls 3*a* and 3*b* in FIG. 4 in a force or pressure control mode.

FIG. 4 shows one embodiment of an apparatus which comprises a pinch roll unit (3*a* or 3*b*) employed in removing tension variations in the Steckel mill (4) rolling process. The pinch roll unit (3*a*) mounted on the entry side of the mill has a similar counterpart on the opposite side of the mill (3*b*). The steel strip passes from the entry coiling furnace (1*a*) to the exit coiling furnace (1*b*) via the entry deflector roll (2*a*), the entry pinch roll unit (3*a*) through the mill stand (4), the exit pinch roll unit (3*b*), exit deflector roll (2*b*) and into the exit coiling furnace (1*b*). After rolling a complete pass in one direction the mill (4) reverses and the process is repeated in the opposite direction. The sequence of forward and reverse passes finishes when the strip is reduced in thickness to the required final thickness.

The principal of operation is that the tension of the strip between the reduction stand (4) and the coiling or uncoiling drums (1*a*) and (1*b*) can be controlled by allowing the upper roll in the pinch roll units (3*a*) and (3*b*) to exert a controlled force on the strip. This can be done by controlling the pressure in a hydraulic or pneumatic cylinder attached to the upper pinch roll assembly in the pinch roll units. Alternatively an electric motor or a spring could be used.

Unfortunately a practical pinch roll unit has to be able to withstand very high forces on thick and wide strips and consequently has a high inertia. It is easy to show by calculation that the inertia of a practical pinch roll unit is so large that simply controlling the cylinder force acting on the pinch roll cannot eliminate the tension variations caused by eccentric build up of the coil. At high coiling speeds and on thin strips the inertia of the pinch roll is such that the tension variations are large enough to cause significant width and gauge variations even if the force control of the pinch roll actuating cylinder was perfect.

Figure 5:
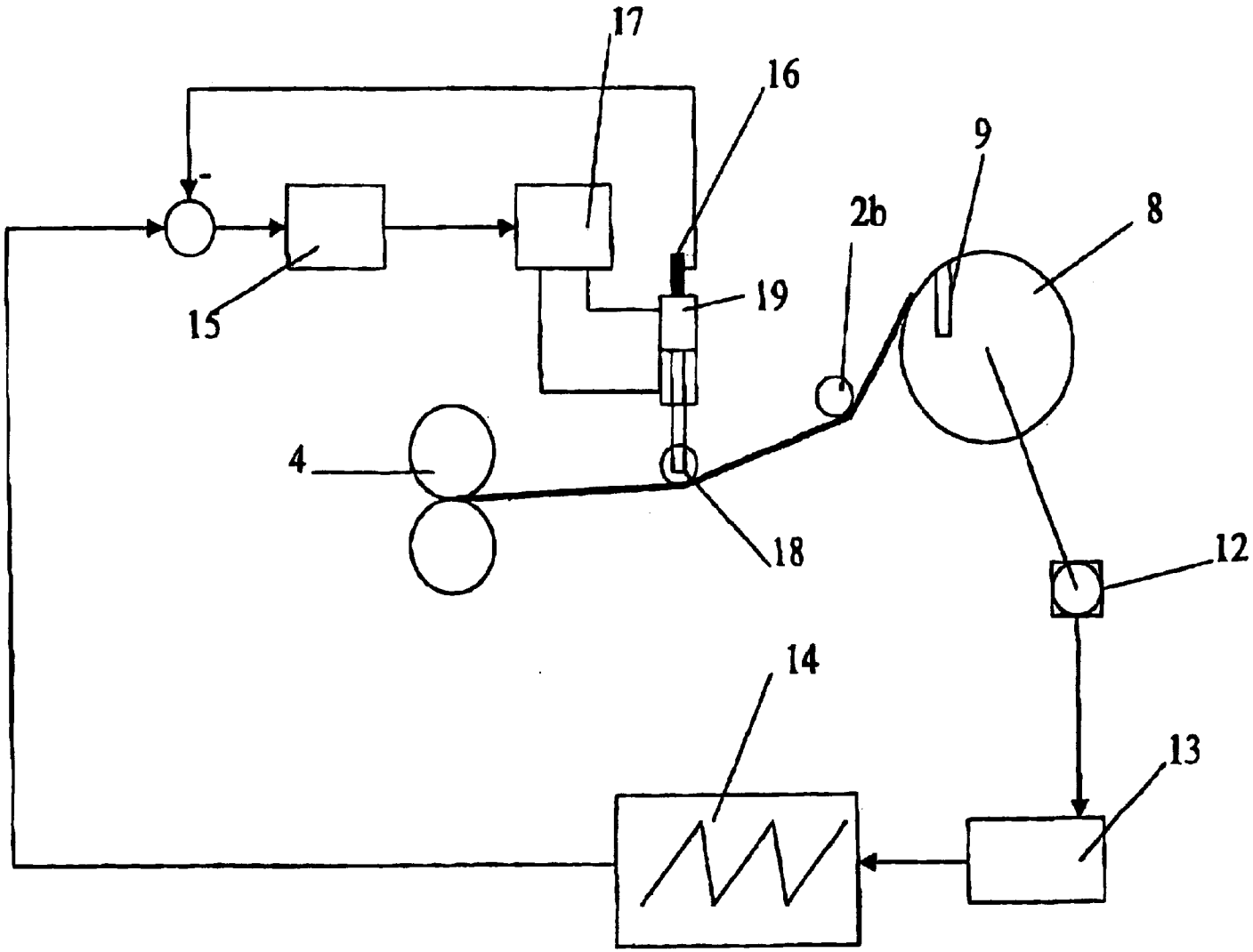
FIG. 5 is a diagram showing a schematic representation of the coiler drum, the pinch roll unit, the transducers and the control system.

FIG. 5 is a diagrammatic representation of a specific embodiment of the invention showing one of the coiler drums and pinch rolls. The angular position of the drum (8) is measured by a suitable transducer (12) such as an encoder or resolver. The electronic unit (13) adds an amount on to the measured angle to phase advance the signal in order to compensate for various factors. The amount of phase advance required depends on both the response time of the pinch roll unit and the speed of rotation of the coiler drum, which can be calculated from the angular position measurement.

The electronic unit (14) calculates the position of the pinch roll which will compensate for a predetermined amplitude of eccentricity of the coil. This calculation is based on the geometry of the pinch roll (18) relative to the mill (4), the deflector roll **(2*b*) the expected amplitude of the eccentric bump in the coil diameter and the angular position of the slot in the coiler drum (9). The required pinch roll position for any given time is then passed to the pinch roll position controller (15). This electronic unit takes the measured pinch roll position from the position transducer (16) and produces a signal to the servo valve (17) to move the pinch roll actuator cylinder (19) and hence move the pinch roll (18)**. This position changes with time as necessary.

Figure 6:
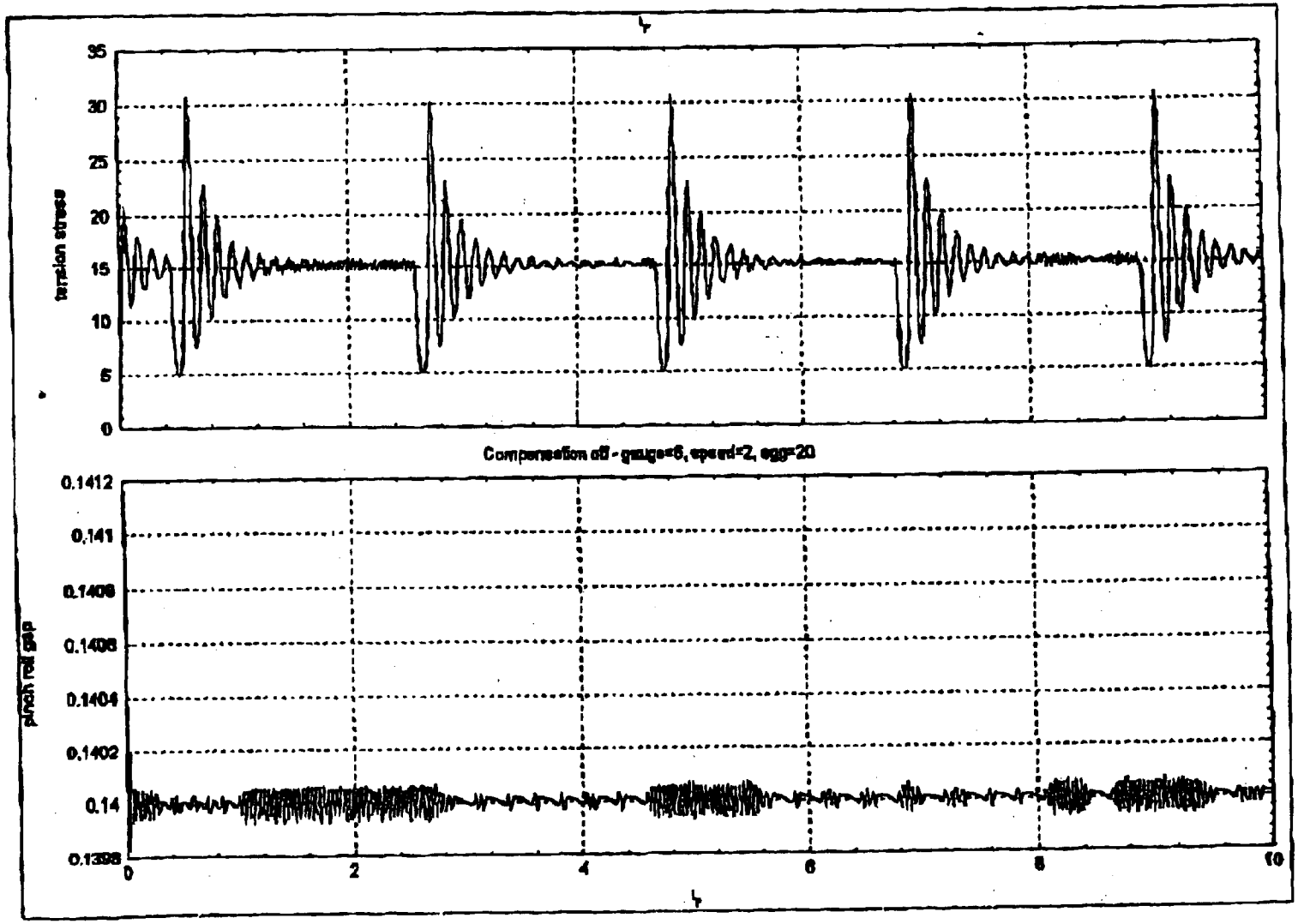
FIG. 6 is a graph showing the results of a calculation to illustrate how the strip tension varies if the pinch roll position is kept constant during coiling with an eccentric coil.

FIG. 6 is a graph to illustrate the results of a calculation to show the strip tension variation when the pinch roll is not moved. The lower graph shows the pinch roll position and the upper graph illustrates the very large tension variations which are caused by the eccentricity in the coil diameter. The pattern of tension variations repeats once for each complete revolution of the coiler drum.

Figure 7:
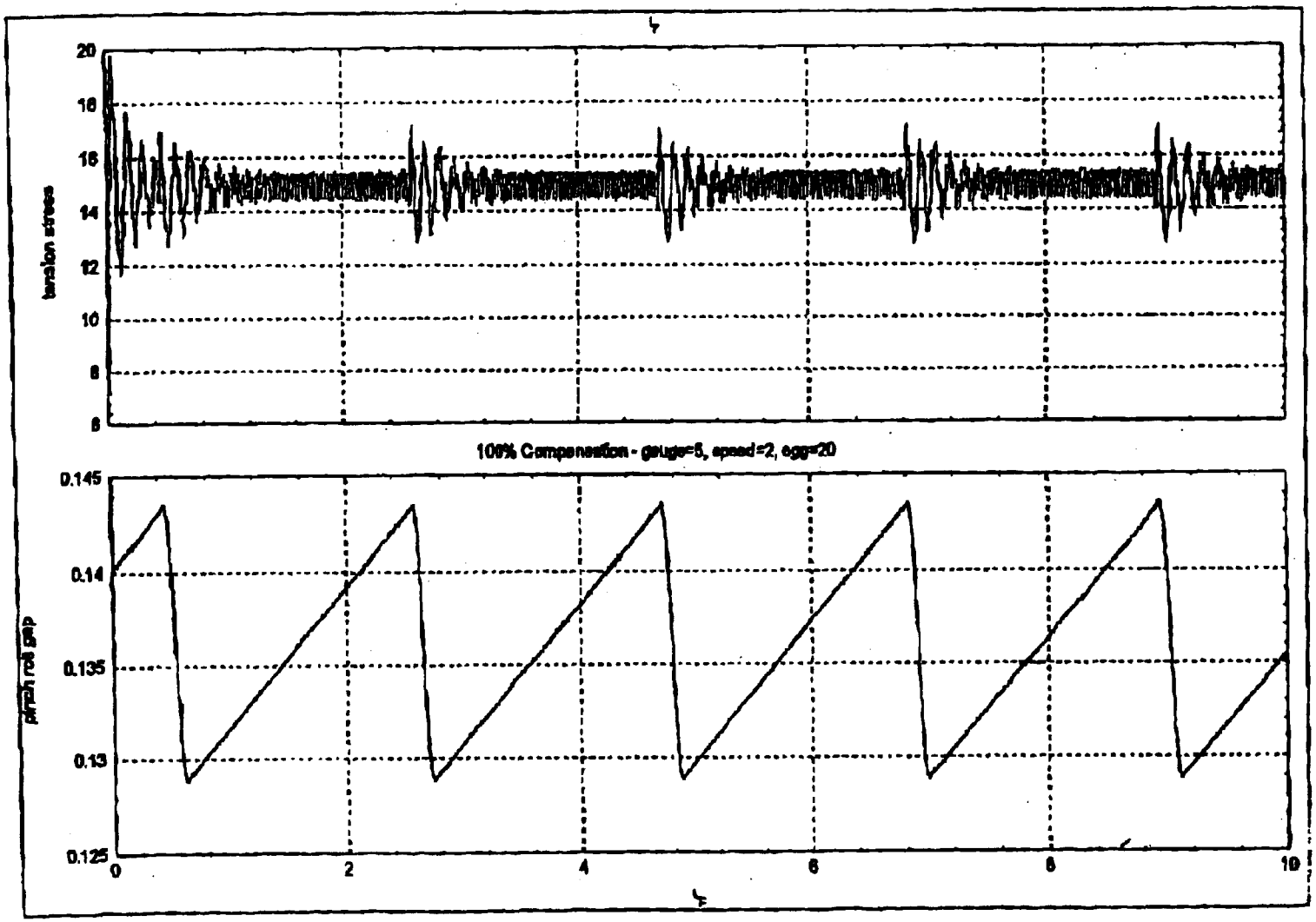
FIG. 7 is a graph showing the results of a calculation to illustrate how the strip tension varies if the pinch roll position is moved as a function of the coiler angle as provided for in this invention.

FIG. 7 is a graph to illustrate the results of a calculation to show the strip tension variations when the pinch roll is operated in a manner according to this invention. The lower graph shows the pinch roll position. This pattern repeats once for each revolution of the coiler drum. The top graph shows the pattern of tension variations in the strip. It is clear that the amplitude of the tension variations when the pinch roll is operated according to the invention are very much reduced compared with those in FIG. 6.

In the simplest embodiment of the invention the required pattern of pinch roll movement as a function of the coiler drum angle is predetermined according to the geometry of the apparatus and the anticipated coil eccentricity amplitude.

The operation of the invention can be improved by making the anticipated amplitude of the eccentricity of the coil a function of the strip material type, strip thickness, strip temperature, the number of passes of the strip through the process and the number of laps on the coil, since these factors have an effect on the bend radius of the strip around the corner of the coiler drum slot and the amplitude of the bump in the coil diameter as a result. Hence further provision in the invention is made for automatically adjusting the movement pattern for the pinch roll as a function of these variables.

In addition the invention can be extended to include feed back to the calculation process of measured variables for the operation. It is possible to use a coiler speed signal and/or a tension measurement signal and/or a coil diameter measurement signal to automatically modify the coil eccentricity amplitude which is used in the calculation of the required pinch roll movement pattern.

In the case of coiler speed, it the coil eccentricity amplitude is greater than the predicted amplitude then the increased tension as the strip winds over the coiler drum slot will cause the drum speed to slow down and then speed up. Conversely if the coil eccentricity amplitude amplitude is smaller than the predicted amplitude then the movement of the pinch roll will cause a loss of tension as the strip winds over the coiler drum slot and an increase in tension on the opposite side of the coil. Consequently a positive correlation between coiler speed changes and the pinch roll position indicates that the predicted amplitude is too large whereas a negative correlation indicates that the predicted amplitude is too small, In either case the predicted amplitude can be adjusted accordingly.

One possible method of obtaining a tension measurement signal would be to install load cells above the deflector rolls **2*a* and 2*b***. If the true coil eccentricity amplitude is larger than the predicted amplitude then the tension will tend to increase as the strip passes over the coiler drum whereas if the predicted amplitude of the coil eccentricity is greater than the actual amplitude then the movement of the pinch roll will be too large and the tension will tend to decrease as the strip passes over the coiler drum slot. Consequently a positive correlation between the tension signal and the pinch roll movement would indicate that the amplitude of the eccentricity is greater than that originally predicted whereas a negative correlation would indicate that it is smaller than originally predicted. In either case the predicted amplitude can be adjusted accordingly.

The environment of a steckel mill coiler/uncoiler is such that it would be very difficult to construct a sufficiently robust and reliable coil diameter sensing device along the lines of that described in GB2074138. However it would be possible to use non-contact optical or inductive measuring devices to obtain a coil diameter signal. Whatever the method of coil diameter measurement which was used it is readily apparent that the measured coil diameter signal can be directly entered into the calculation of the pinch roll movement which will be required to minimize the tension variations.

What is claimed is:

1. An apparatus for the handling of a metal strip, wherein the apparatus includes a first coiler and a second coiler and a moveable roll, a strip path being defined between a first location and a second location, wherein a movement of said movable roll can change the length of said strip path, said coilers having a rotational angular position that changes with rotation thereof, said apparatus further comprising a measurer of the rotational angular position of at least one of said coilers, and an actuator for said moveable roll, said actuator being provided with signals from said measurer, wherein the position of said moveable roll can be defined, at least in part, as a function of the rotational angular position of at least one of said coilers.

2. The apparatus of claim 1, wherein said measurer comprises at least one angular position transducer, wherein said at least one angular position transducer can measure the rotational angular position of at least one of said coilers during coiling or uncoiling.

3. The apparatus of claim 1, further comprising a roll position controller, wherein said roll position controller can control the movement of said moveable roll via said actuator, wherein said actuator comprises a hydraulic cylinder.

4. The apparatus of claim 1, further comprising a moveable roll position transducer, wherein said moveable roll position transducer can be used to measure the position of said moveable roll.

5. The apparatus of claim 1, further comprising an electronic controller and a servo valve, wherein said electronic controller and said servo valve can be used to control the position of said moveable roll according to a reference position.

6. The apparatus of claim 1, further comprising a control system, wherein said control system can control the position of said movable roll in response to information from said measurer.

7. The apparatus of claim 1, wherein said moveable roll is provided between one of said coilers and a rolling mill stand or other processing stage.

8. The apparatus of claim 1, wherein at least one of said coilers comprises a drum with a slot, wherein said slot can receive an end of a metal strip, wherein said slot rotates with rotation of said drum to cause a metal strip having an end placed in said slot to coil about said drum or to uncoil from said drum depending on the direction of rotation, and wherein the rotational angular position of said at least one of said coilers is determined by the rotational position of said slot.

9. An apparatus for the coiling/uncoiling of a metal strip, comprising at least one coiler for coiling or uncoiling a metal strip thereabout, said apparatus providing a strip path for a metal strip to follow when a metal strip is operatively connected to said at least one coiler, said apparatus further comprising a moveable roll in said strip path, wherein a movement of said moveable roll can change the length of said strip path, said at least one coiler having a rotational angular position that changes with rotation thereof, said apparatus further comprising an angular position transducer, wherein said angular position tranducer can measure the rotational angular position of at least one of said at least one coiler, wherein the position of said moveable roll is automatically controlled as a function of the rotational angular position of at least one of said at least one coiler.

10. The apparatus of claim 9, further comprising a roll position controller, wherein said roll position controller can cause movement of said moveable roll, wherein said roll position controller comprises a hydraulic cylinder.

11. The apparatus of claim 9, further comprising a roll position transducer, wherein said roll position transducer can be used to measure the position of said roll.

12. The apparatus of claim 9, further comprising an electronic controller and a servo valve, wherein said electronic controller and said servo valve can be used to control the position of said roll according to a reference position.

13. The apparatus of claim 9, further comprising a control system, wherein said control system can control the position of said movable roll in response to information from said angular position transducer.

14. The apparatus of claim 9, wherein said moveable roll is provided between at least one of said at least one coiler and a rolling mill stand or other processing stage.

15. The apparatus of claim 9, wherein at least one of said coilers comprises a drum with a slot, wherein said slot can receive an end of a metal strip, wherein said slot rotates with rotation of said drum to cause a metal strip having an end placed in said slot to coil about said drum or to uncoil from said drum depending on the direction of rotation, and wherein the rotational angular position of said at least one of said coilers is determined by the rotational position of said slot.

16. A method of handling a metal strip, comprising passing a metal strip from a first coiler to a second coiler via a strip path defined between a first location and a second location, contacting a moveable roll with the metal strip between the first location and second location, and measuring the rotational angular position of at least one of the coilers and moving the moveable roll so as to change the length of the strip path as a function of the rotational angular position of at least one of the coilers.

17. The method of claim 16, wherein the diameter of a coil formed by said metal strip about a coiler has an eccentricity and rotation of the coil causes tension variations in the metal strip due to the eccentricity, wherein the tension variations in the metal strip follow a tension variation pattern associated with the rotational angle of the coiler, said method further comprising moving the moveable roll in a roll movement pattern to reduce the tension variations caused by rotation of the coil.

18. The method of claim 17, wherein the roll movement pattern is calculated in advance of said passing step as a function of the anticipated eccentricity amplitude at varying rotational angles of the coil.

19. The method of claim 18, wherein the metal strip is coiled on one of the coilers to form a coil, the coil has an anticipated amplitude of eccentricity and the pattern of movements of the moveable roll adjusts the strip path length to account for the anticipated amplitude of eccentricity of the coil.

20. The method of claim 19, wherein the anticipated amplitude of the coil diameter eccentricity is based on at least one of the group consisting of the composition of the strip material, the strip thickness, the strip temperature, and the number of laps of the strip on the coil.

21. The method of claim 16, further comprising moving the movable roll in response to a signal, wherein the movable roll has a response time, and adding an offset to the measured coiler rotational angular position in order to phase advance the signal to compensate for the response time of the moveable roll.

22. The method of claim 21, wherein the offset is a function of the coiler rotation speed.

23. The method of claim 16, further comprising using a control system to control the position of the roll in response to the rotational angle of the coiler in combination with further information selected from the group consisting of the thickness of the strip, the material forming the strip, the temperature of the strip, the number of passes of the strip through the rolling mill stand or other process stage, the number of laps of the strip on the coiler, the geometry of the strip length, the geometry of the moveable roll to the rolling mill stand or other process stage, the geometry of the moveable roll to a further roll, the response time of the moveable roll, and the speed of rotation of the coiler.

24. The method of claim 16, further comprising calculating an eccentricity amplitude for the system and obtaining a corrected eccentricity amplitude by correcting the calculated eccentricity amplitude.

25. The method of claim 24, wherein the calculated eccentricity amplitude is obtained by measuring the rotational speed of the coiler, wherein a decrease in speed of the coiler corresponds to the strip being applied over the location of eccentricity resulting in a corrected eccentricity amplitude which is greater than the calculated eccentricity amplitude and/or an increase in the rotational speed of the coiler at an angular position where the strip is applied over the location of the eccentricity results in a corrected eccentricity amplitude which is lower than the calculated eccentricity amplitude.

26. The method of claim 24, wherein the calculated eccentricity amplitude is corrected by measuring the tension in the strip and/or by measuring the load on the moveable roll, wherein, if the tension in the strip increases and/or the load on the roll increases as the strip is applied over the position of the eccentricity then the corrected eccentricity amplitude is greater than the calculated eccentricity amplitude, and/or if the tension is reduced and/or the load on the roll is reduced as the strip is applied over the location of the eccentricity then the corrected eccentricity amplitude is less than the calculated eccentricity amplitude.

27. The method of claim 24, wherein the calculated eccentricity amplitude is corrected by measuring the coil diameter and particularly the coil diameter for the eccentricity.

28. The method of claim 16, wherein at least one of the coilers comprises a drum with a slot, one end of the metal strip is inserted in the slot, the slot rotates with rotation of the drum to cause the metal strip to coil about the drum or to uncoil from the drum depending on the direction of rotation, and wherein the rotational angular position of the coiler is determined by the rotational position of the slot, each revolution of the coiler drum causing a pattern of tension variations in the metal strip associated with the eccentricity caused by the insertion of the end of the metal strip in the slot, wherein said method comprises moving the moveable roll in a moveable roll movement pattern to reduce the amplitude of the pattern of tension variations in the metal strip during rotation of the drum.

29. A method of handling a metal strip, the method comprising passing a metal strip from a first coiler to a second coiler, wherein a strip path for the metal strip is defined between a first location and a second location, contacting the metal strip with a moveable roll between the first location and second location, the method further comprising measuring the angular position of at least one of the coilers and moving the moveable roll so as to change the length of the strip path, the moveable roll being moved as a function of the rotational angular position of at least one of the coilers, wherein the moveable roll is moved in response to a signal and the moveable roll has a response time, the method further comprising adding an offset to the measured coiler rotational angular position in order to phase advance the signal to compensate for the response time of the moveable roll.

30. The method of claim 29, wherein the offset is a function of the coiler drum speed.

* * * * *